United States Patent [19]

Asselman et al.

[11] 4,084,376

[45] Apr. 18, 1978

[54] HEATING SYSTEM

[75] Inventors: George Albert Apolonia Asselman; Herman Henricus Maria Van der AA; Roelf Jan Meijer, all of Eindhoven, Netherlands

[73] Assignee: U.S. Philips Corporation, New York, N.Y.

[21] Appl. No.: 262,665

[22] Filed: Jun. 14, 1972

Related U.S. Application Data

[63] Continuation of Ser. No. 81,337, Oct. 16, 1970.

[30] Foreign Application Priority Data

Oct. 30, 1969 Netherlands ..... 6916336

[51] Int. Cl.[2] ..... F02G 1/04

[52] U.S. Cl. ..... 60/523; 60/524; 165/104 S; 165/105

[58] Field of Search ..... 165/105, 104, 104 S; 60/517, 524, 523

[56] References Cited

U.S. PATENT DOCUMENTS

| | | | |
|---|---|---|---|
| 1,987,119 | 1/1935 | Long | 165/105 X |
| 3,029,596 | 4/1962 | Hanold et al. | 60/517 X |
| 3,468,300 | 9/1969 | Geyer et al. | 165/105 X |
| 3,502,138 | 3/1970 | Shlosinger | 165/105 X |
| 3,517,730 | 6/1970 | Wyatt | 165/105 X |
| 3,548,930 | 12/1970 | Byrd | 165/105 X |
| 3,563,226 | 2/1971 | Rockenfeller et al. | 126/204 |

FOREIGN PATENT DOCUMENTS

| | | | |
|---|---|---|---|
| 139,840 | 1/1951 | Australia | 165/105 |

*Primary Examiner*—Albert W. Davis, Jr.
*Attorney, Agent, or Firm*—Frank R. Trifari; David R. Treacy

[57] ABSTRACT

A heating system for supplying thermal energy to a heater of a machine such as a hot gas engine, this system using a heat-transporting medium which flows within a closed space between a heat-receiving portion to a heat-discharging portion. Thermal energy is supplied from a heat source through a wall in the heat-receiving portion with the transporting medium changing from the liquid phase to the-vapor phase, and the absorbed thermal energy is transferred to the heater in the heat-discharging portion by changing from the vapor phase into the liquid phase. The wall parts of the heat-receiving portion, through which thermal energy can be supplied from the heat source to the transporting medium, comprise on their surface contacting this medium of a layer of a porous material having a capillary structure whereby liquid-phase medium is distributed on said walls.

7 Claims, 3 Drawing Figures

HEATING SYSTEM

This is a continuation of application Ser. No. 81,337, filed Oct. 16, 1970.

BACKGROUND OF THE INVENTION

The invention relates to a heating system for supplying thermal energy to a heater of a machine in which a working medium performs a thermodynamic cycle, for example, a hot-gas engine. The system comprises a metal, a metal alloy, a metal salt or a mixture of metal salts serving as a heat-transporting medium and being present in a closed space, and to which on the one hand thermal energy can be supplied from a heat source through a wall, with the transporting medium changing from the liquid phase into the vapour phase, and on the other hand can deliver the absorbed thermal energy to the heater with the transporting medium changing from the vapour phase into the liquid phase.

A heating system of the above-described type is known from Dutch patent specification 58,355. Such a system in which the heat of evaporation and condensation is used to transport thermal energy from the heat source to the heater for example, has the advantage that a large heat transport can be obtained without complicated and expensive pumps or valves being necessary for transport. The transporting medium is chosen to be so as to have a condensation temperature which corresponds to the operating temperature of the heater of the thermo-dynamic machine. The transporting medium is then evaporated by the thermal energy supplied from the heat source. As a result of the fact that the temperature and hence the vapour pressure at the area of the heat source is slightly higher than at the area of the heater, the vapour will flow to the heater. The vapour condenses there while supplying thermal energy and the condensate can be conducted back again to the heat source either by gravity or by means of a simple pump.

SUMMARY OF THE NEW INVENTION

It is the object of the invention to provide an improvement of the above-described system and for that purpose it is characterized in that the heater is arranged in the closed space and at least the wall parts, through which thermal energy can be supplied from the heat source to the transporting medium, comprise on their side which is in contact with said medium a layer of porous material which during operation is in local contact with liquid coming from the heater.

A first remarkable advantage of the system acccording to the invention is that the heater is arranged directly in the closed space, so that the transporting medium condenses on the heater which provides a very good heat transfer. As a result of the said good heat transfer, the surface of the heater which must be available for the heat transfer may hence be smaller than in systems in which the transporting medium experiences no phase transition. This means a small heater and hence a thermodynamic machine having a smaller dead volume in the heater than in known machines.

The condensate returning from the heater will have the tendency to collect on the lowest places of the part of the space to which the heat source supplied thermal energy. This means that the wall surface to which on the one hand thermal energy is supplied from the heat source and which on the other hand should deliver thermal energy to the transporting medium is in contact with condensate for a small part only and is in contact with vapour for another part. This means that the supply of thermal energy throughout the available wall surface will certainly not be optimum so that the construction will be larger than is optimum achievable, while in addition the wall parts which are in contact with vapour run the risk of becoming overheated.

By providing, according to the invention, the wall parts available for the passage of thermal energy with a porous layer of material which during operation is in local contact with condensate it is achieved that, due to the capillary action in the porous layer, the condensate is evenly distributed between the whole wall part taking part in the heat transfer. This means that with the same wall surface area a many times larger supply of thermal energy can be realized or, with the same supplied heat current, a smaller wall surface area will be sufficient. By providing the porous layer the heater system becomes simpler while a more efficient use of the supplied thermal energy is realized.

A porous layer of material should be understood to mean within the scope of the present application a porous layer having ducts which extend in the desirable direction of transportation throughout the length of the layer in question and through which liquid is transported under the influence of capillary forces. Such a layer may be, for example, a porous gauze layer or it may be formed by fine grooves in the relative surface covered by a gauze layer.

The return of the condensate formed on the heater can occur by means of gravity. This involves, however, that the heat source is arranged lower than the heater. Particularly when used in vehicles or vessels which expierence changes in position, this may present problems. In order to avoid said problems, in a further construction of the heating system according to the invention, the part of the closed space communicates, in the proximity of the heater where the formed liquid collects, through a further layer of porous material with the said layer of porous material on the wall parts through which thermal energy can be supplied. In this manner, independent of any difference in height between the heat source and the heater, liquid will always flow through the layer of porous material in the direction of the place having a higher temperature.

The heat source may be constituted by a burner.

A further embodiment of the heating system according to the invention is characterized in that one or more containers are present which are filled with a heat-accumulating material, the walls of said containers which form a partition with the closed space comprising on their side facing said space a layer of porous material.

In a further embodiment one or more containers are present which are filled with a metal or a mixture of metals, each of the said containers comprising a supply for the dosed supply of an oxidant which reacts with the metal or mixture of metals while evolving heat, the walls of said containers which form a partition with the closed space comprising, on their side facing said space, a layer of porous material.

In these two last-described embodiments according to the invention, a heating device is furthermore present for supplying thermal energy to the said containers.

The invention will now be described in greater detail with reference to the accompanying drawings, in which a few heating systems are shown diagrammatically by way of example.

DESCRIPTION OF THE PREFERRED EMBODIMENT

Figure 1:
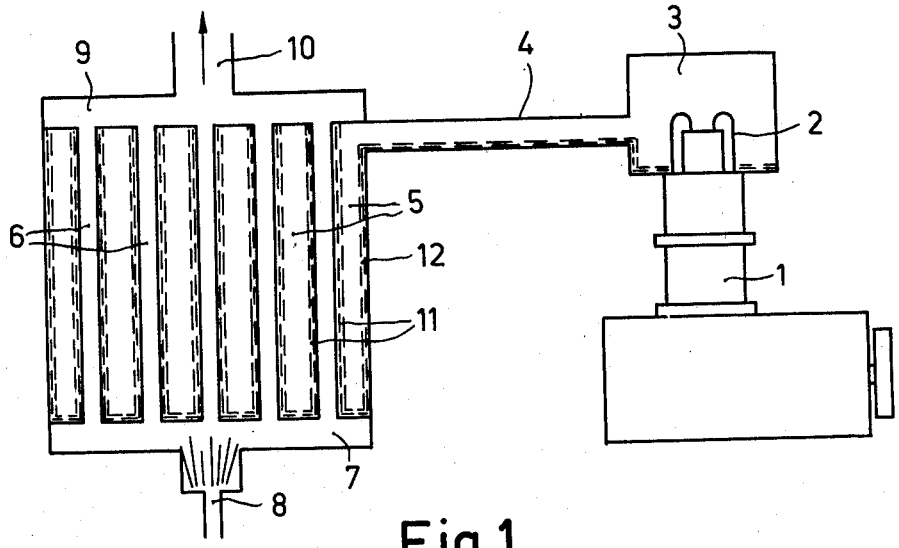
FIG. 1 diagrammatically shows a heating system with a burner.

Reference numeral 1 in FIG. 1 denotes a hot-gas engine comprising a heater 2 to which thermal energy is to be supplied. A container 3 has heat discharging portion 3*b* generally surrounding the heater 2 of heat-receiving portion 3*a* of the container 3 which communicates with a space 5 through a duct 4. Container 3 where heat is discharged to the heater, duct 4 and space 5 together constitute a closed space containing Na. The space 5 where heat is received comprises a number of ducts 6 which communicate at one end with a burner chamber 7 comprising a burner 8, and on the other hand with a collection space 9 provided with an exhaust 10 for fuming gases.

On their side facing the space 5, the ducts 6 comprise a layer of porous material 11. The layers of material 11 are in contact on their lower side with a further layer of porous material 12 which extends along the wall of the space 5 and the duct 4 to in the container 3.

The operation of this device is as follows: when the burner 8 is put in operation, warm fuming gases will flow through the ducts 6 to the exhaust 10. As a result of this the walls of the ducts 5 will be heated and liquid Na present in the porous layers 11 will evaporate. The formed vapour flows to the slightly cooler heater pipes 2 on which the vapour condenses while delivering its thermal energy to the medium in the hot-gas engine 1. Due to the capillary action in the layer of material 12, the formed condensate will flow back through said layer to the space 5 and have the tendency there of collecting at the bottom. However, the porous layers 11 will transport said condensate upwards along the walls of the ducts 6, evaporation occurring along the whole wall of each of the ducts 6.

In this manner an extremely readily operating heating system is obtained in which the overall area of the duct 6 is actively involved in the heat transfer of the fuming gases to the heat-transporting Na. This means a large supply of thermal energy. The large flow of supplied thermal energy is conducted by the sodium vapour to the heater pipes 2 where the vapour condenses. As a result of said condensation directly on the heater pipes 2, an extremely good heat transfer is obtained there also, so that a comparatively small heater area will be sufficient. As a result of this the dead space in the hot-gas engine will be small, which benefits the efficiency.

The condensate formed on the heater pipes 2 flows downwards where it lands in the porous layer 12. As a result of the capillary action in the layer 12, the condensate there will flow on to space 5. In space 5, the liquid is distributed between the walls of the ducts 6 by the layers 11. Local overheating of the walls of the ducts 6 is excluded. Because the liquid through the porous layers always flows to the places of evaporation, a temperature compensation always takes place. Instead of contacting the layer 12 below in the container 5 with the layers 11, it may be useful in circumstances to contact the layer 12 above in the container 5 with the layer 11 so that the condensate can flow downwards through the layers 11.

As a transporting medium may be used, in addition to Na, other metals, metal alloys, metal salts or mixtures of metal salts. The choice will be determined for example, by the desirable operating temperature, and the boiling point of the medium in question.

Figure 2:
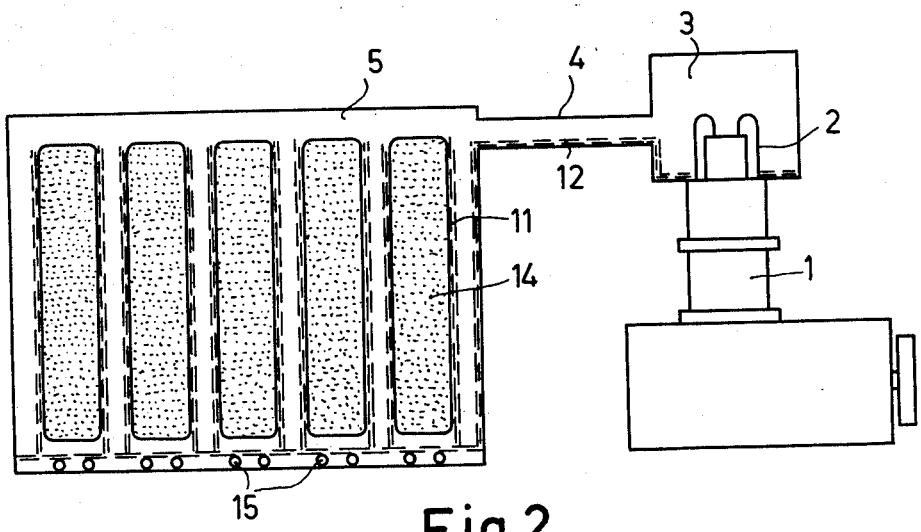
FIG. 2 diagrammatically shows a heating system having a number of containers filled with a heat accumulating material.

FIG. 2 shows a heating system which in general corresponds to that shown in FIG. 1, but in which a number of containers 14 filled with LiF or another heat-accumulating material, for example, aluminum oxide, are arranged in the space 5 of heat-receiving portion 3*a* of the heat-pipe container 3. The containers 14 again comprise on their outside the layers of porous material 11 while the porous layer 12 again communicates with the container portion 3*a*. Furthermore, an electric heating spiral 15 or another heat source, for example, a normal burner, is present. The operation is as follows: By means of the electric heating spiral 15, thermal energy is supplied as a result of which Na evaporates. Since the containers 14 are still cold, the formed vapour condenses on the walls of the containers 14, thermal energy being supplied to said containers. The condensate flows downwards and is evaporated again by the heating spiral 15. In this manner, the thermal energy supplied by the heating spiral 15, is very efficiently supplied uniformly to the containers 14. When all the LiF in the containers 14 has melted, the heat accumulator is hence charged and the stored thermal energy can be used for operating the engine 1 in places where no fuming gases may be evolved or in places where no air of combustion is available for a normal burner.

When operating the engine 1, Na vapour condenses on the heater pipes 2. The condensate again flows through the layer 12 back to space 5, where the porous layers 11 ensure the distribution of the liquid between the walls of the containers 14, where the liquid evaporates again. The withdrawal of thermal energy from said containers occurs very uniformly so that the temperature will again be substantially the same everywhere. In this manner a heater system with heat accumulator is obtained in which both the charging of the containers 14, and the withdrawal of thermal energy from said containers takes place by means of evaporation and condensation of Na. The whole wall of each of the containers 14 takes part in the heat transfer so that a large quantity of thermal energy can very rapidly be supplied and withdrawn, respectively. The system comprises no moving components, such as pumps and control valves, so that a great reliability and long lifetime are ensured. Local overheating of wall parts is substantially excluded in that the condensing or evaporating Na compensates for temperature differences.

Of particular advantage in this embodiment is that both the charging with thermal energy and the withdrawal of thermal energy from the containers 14 occurs by means of the same heat transporting medium.

Figure 3:
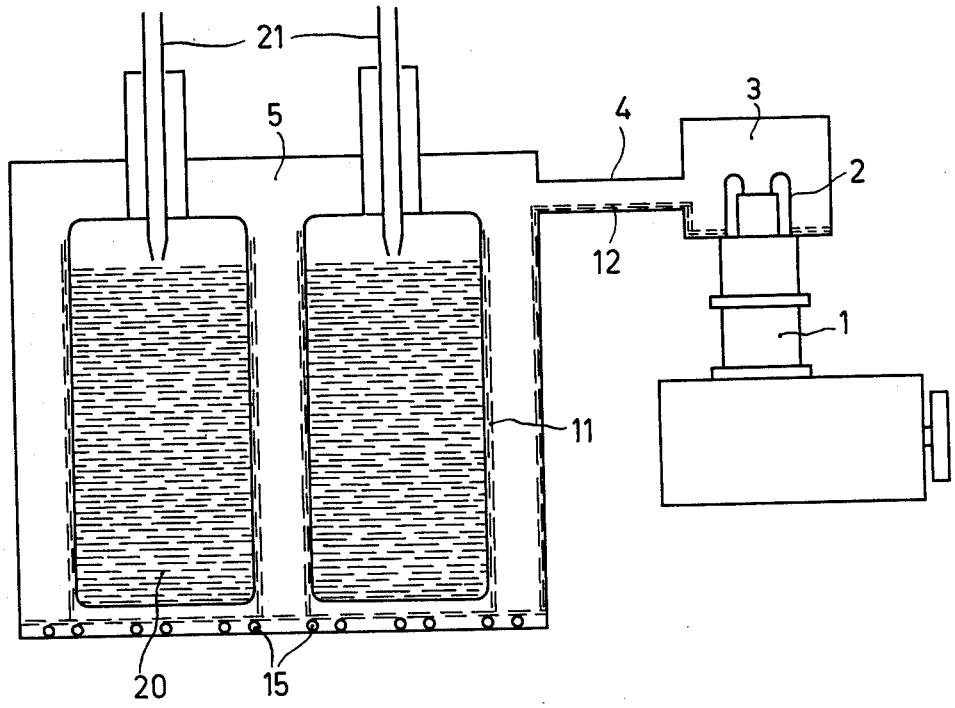
FIG. 3 diagrammatically shows a heating system having two containers filled with a mixture of metals capable of reacting with an oxidant.

FIG. 3 diagrammatically shows an embodiment of a heating system in which a number of containers 20 are arranged in the space 5 and are filled with a metal, for example, Li or a mixture of metals. An oxidant, for example, $SF_6$, can be applied to each of the said containers via a supply duct 21. The operation of this system is as follows: Thermal energy is first supplied by the heating spiral 15. This causes Na to evaporate, which vapour condenses on the walls of the containers 20 while supplying thermal energy. After supplying sufficient thermal energy, the metal in the containers 20 will be melted. The heating spiral 15 is then switched off and oxidant is supplied to the containers 20 through the ducts 21. This oxidant reacts with the metal while evolving heat. Due to this heat evolution, Na will evaporate on thewalls of the containers 20. The vapour flows to space 3, where it condenses on the heater. The condensate again flows via the porous layers 12 and 11 back to the walls of the containers 20. In this manner again a very readily operating heating system is obtained. The Na will again ensure that the same temperature prevails substantially at any place of the system.

It will be obvious that the chemical heating system (container 20, oxidant supply duct 21, and so on) is shown greatly simplified for clarity but that other more complicated systems can be used in the same manner.

What is claimed is:

1. In a hot-gas engine including a heater and an operable primary heat source, the improvement in combination therewith of heat-pipe heating means for transferring heat from said primary heat source to said heater, and heat accumulator means heated by said heat pipe heating means and operable as a secondary heat source for said heat pipe independent of said primary heat source, said heat pipe heating means formed as a closed outer container whose walls have inside surfaces, the walls defining a heat-receiving portion, a heat-discharging portion, and a duct interconnecting said two portions, with said heater at least partially within said heat-discharging portion for receiving heat therefrom, said heat pipe heating means further comprising a heat-transporting medium within said outer container walls, this medium being cyclically changeable between its liquid and vapor phases, said primary heat source operable for transmitting heat into said heat-receiving portion of said heat pipe heating means for vaporizing the medium therein, said heat accumulator comprising at least one inner container disposed within said heat-receiving portion, this inner container having walls which have an outside surface and containing a heat accumulating material that is cyclically changeable between its liquid and solid states, and a capillary layer that is wetted by said liquid-phase medium, this layer disposed on at least part of the outside surface of said inner container walls, and on the inside surfaces of walls of said outer container, forming a continuous patch for condensate from said inner container and heater to said heat-receiving portion, whereby (A) when said primary heat source provides thermal energy to said heat-receiving portion of said heat pipe, said liquid-phase medium therein vaporizes and flows to and condenses on and transmits thermal energy (1) to the heater in said heat discharging portion and (2) to the outer wall surfaces of said inner container for melting the heat-accumulating material therein which then becomes a secondary source of heat, condensate from said heater and said inner container outer wall surfaces subsequently accumulating via said capillary layers in said heat receiving portion and (B) said heat accumulating material functions as a second source of heat for said heat receiving portion independently of said primary source for vaporizing heat transport medium in said heat pipe for conveying thermal energy to said heater in said heat discharging portion.

2. An engine according to claim 1 wherein said heat source comprises at least one electrical heating element disposed within said heat-receiving portion.

3. Apparatus according to claim 1 wherein said heat-transporting medium is sodium (Na).

4. Apparatus according to claim 3 wherein said heat-accumulating material is one such as lithium fluoride (LiF) or aluminum oxide.

5. Apparatus according to claim 1 wherein said heating means comprises a plurality of said inner containers within said heat-receiving portion.

6. Apparatus according to claim 1 wherein said heat-receiving portion of the heating means is spaced from the heat-discharing portion.

7. In combination a hot-gas engine operable with a primary heat source, the engine including a heater part and a heating means for said heater part formed as a heat-pipe comprising a heat discharging portion in which at least, a part of said heater part is situated, a heat-receiving portion for receiving heat from said primary heat source, and a duct connecting said two portions, a heat-transporting, vaporizable liquid medium in said heat pipe, a continuous first capillary layer on inner surfaces of said heat pipe for conducting condensate from the heater to said heat-receiving portion, and a secondary heat source within said heat-receiving portion of the heat pipe comprising at least one inner container containing a heat-accumulating, meltable solid material and a second capillary layer thereon communicating with said first capillary layer, said secondary heat source operable to provide heat to said heat transporting-liquid medium in said heat-receiving portion of the heat pipe independent of heat from said primary heat source, whereby when heat is conducted from the primary heat source to said heat-receiving portion, said liquid medium vaporizes, and flows to, condenses on, and transmits heat to said heater and to said secondary heat source inner container wherein said heat-accumulating material becomes melted, said condensate forming on said heater in said heat-discharging region flowing via said capillary layers to said heat-receiving portion, for re-evaporation.

* * * * *